United States Patent [19]

Tindal

[11] 4,022,145

[45] May 10, 1977

[54] CONTROLLED ONE MAN BOAT

[76] Inventor: Bobby G. Tindal, Rte. No. 1, Pelion, S.C. 29123

[22] Filed: Oct. 6, 1975

[21] Appl. No.: 619,819

[52] U.S. Cl. ..... 114/153; 9/7; 115/18 E

[51] Int. Cl.[2] ..... B63H 21/26; B63H 25/00

[58] Field of Search ..... 9/1 R, 7; 114/153, 144 A; 115/18 R, 18 E, 17, 70

[56] References Cited

UNITED STATES PATENTS

| | | | |
|---|---|---|---|
| 3,039,723 | 6/1962 | Seyffer | 115/17 X |
| 3,052,204 | 9/1962 | Scivally | 115/18 E |
| 3,880,107 | 4/1975 | Miles | 115/25 X |
| 3,881,443 | 5/1975 | Hamp | 115/18 E |

*Primary Examiner*—Trygve M. Blix
*Assistant Examiner*—Gregory W. O'Connor

[57] ABSTRACT

This boat consists primarily of an electrically powered motor which is removably secured to a spring-loaded bracket fastened to the transom of the hull. A pulley secured to the motor shaft, carries upon it a pair of ropes, one each being slidably received within tubing fastened to the floor, the tubing being bent to form back rest means and guide means for the rope, the rope extending forwardly to a pivotable T-type bar arrangement which serves as foot pedal means for rotating the motor.

3 Claims, 3 Drawing Figures

CONTROLLED ONE MAN BOAT

This invention relates to boats and more particularly to a controlled one man boat.

It is therefore the principal object of this invention to provide a boat which will be made of fiberglass and will be powered by an electric motor, the motor being secured to a spring-loaded bracket fastened to the transom of the hull and the motor shaft will bave pulley means secured thereto which will carry a rope which will extend through tubing means that will form seat back rest means as well as guide means for the rope.

Another object of this invention is to provide a boat of the type described, which will have the rope extending to the lower end of a T-shaped bar which will be pivotable and will serve as foot pedal means for steering the boat.

A further object of this invention is to provide a boat of the type described, which will have brace means for the tubing that is secured to the floor, the brace enabling the user to sit comfortably upon cushion means resting against the tubing.

Other objects of the invention are to provide a controlled one man boat, which is simple in design, inexpensive to manufacture, rugged in construction, easy to use and efficient in operation.

These and other objects will be readily upon a study of the following specification and the accompanying drawing, wherein.

Figure 1:
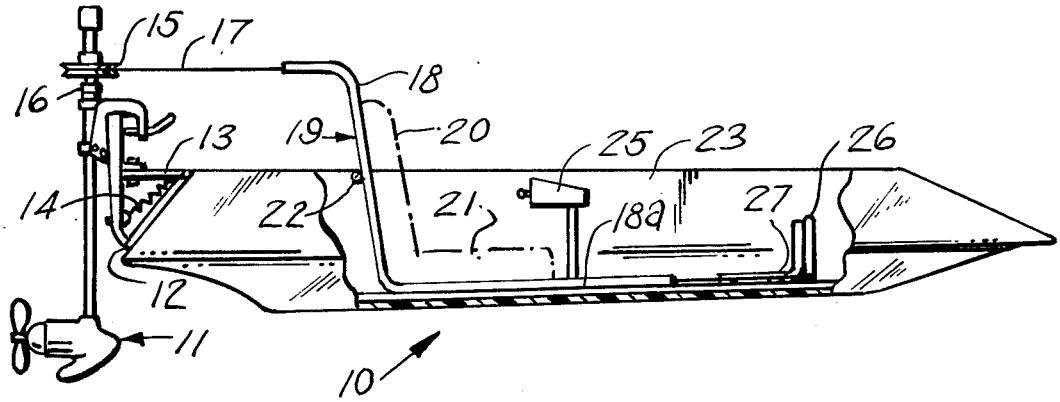
FIG. 1 is a side view of the present invention shown in elevation and partly broken away, with the seat shown in phantom lines.
Figure 2:
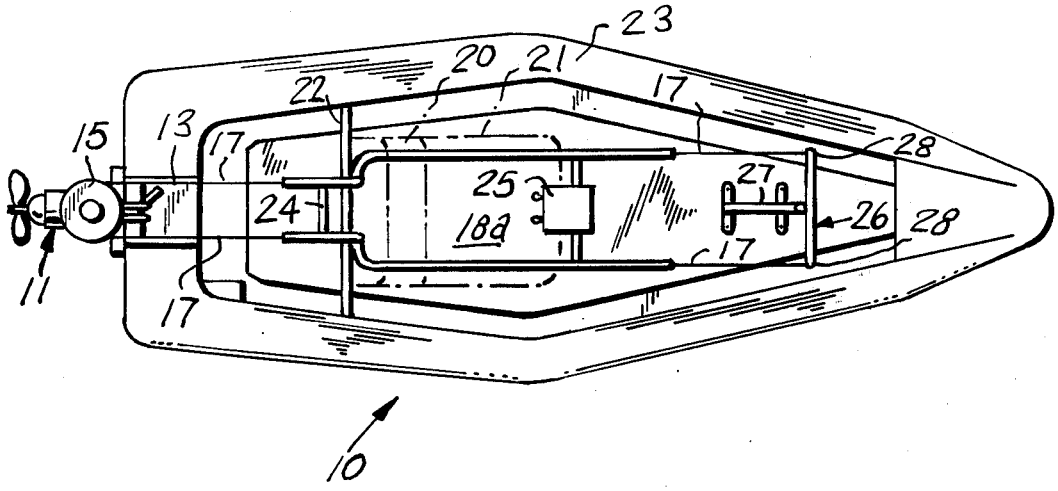
FIG. 2 is a top plan view of FIG. 1.
Figure 3:
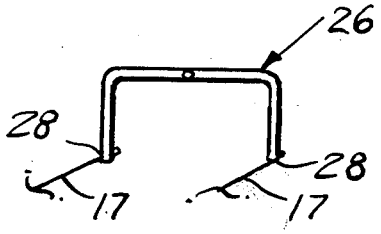
FIG. 3 is a fragmentary perspective view showing the pivotable T-bar removed from the hull of the boat.

According to this invention, boat 10 is shown to include an electrically operated motor 11 which is secured to the transom 12 by means of hinged bracket 13 to which is attached spring 14. The tension of spring 14 is such, that it is just enough to keep the motor 11 from tipping up when it is switched from forward to reverse. A pulley 15 is secured fixedly to shaft 16 in a suitable manner and it carries rope 17 which is freely received within a pair of tubing members 18 which are fixedly secured in a suitable manner to floor 18a of boat 10. The shaft 16 is journalled in a bearing block supported from the transom of the boat as is readily evident by a study of FIG. 1 so that rotation of the shaft will thus steer the motor. A pair of cushions 20 and 21 as shown in phantom lines provides seat means for the operator and the tubing 18 extends upwards higher than a gunwale or top of boat 10 and abuts with cross member 22 which is secured fixedly to the interior sides 23 of boat 10, a cross brace 24 is secured fixedly at each ent to and between the upper portions of tubing 18 so as to provide for rigid structure. The switching console 25 is positioned between the user's legs and fastened fixedly to floor 18*a*. The extending portions of rope 17 are secured fixedly to the lower ends of the foot control member 26 which is pivotably secured to bracket 27 which is secured fixedly to floor 18*a*.

In use, boat 10 being light in weight by being of fiberglass material, sits well even in rough water and boat 10 flips easily into forward or reverse with a small amount of power. The operator steers boat 10 by urging against one or the other end 28 so as to steer boat 10 right or left, the pivoting of member 26 by the feet of the operator, causes the rope 17 around pulley 15 to rotate motor 11.

What I claim is:

1. A controlled one man boat, comprising in combination, an electrically operated motor secured by a spring loaded bracket to a transom of a hull of said boat, a rope for manipulating said electrically operated motor, said rope leading forwardly from said transom towards a space for an operator, a pair of forwardly-rearwardly extending tubular members providing guide means for said rope, a seat and a back rest for said operator, and a pivotable foot rest providing steering means for said motor, said tubular members being parallel to each other and spaced apart, a forward portion of said tubular members being secured to a floor within said hull, an intermediate portion of said tubular members extending upwardly inclined from said floor to an elevation higher than a top gunwale of said boat, and a rear portion of said tubular members extending horizontally rearwardly from said upwardly inclined portion, a cross member secured to said intermediate portion of said tubular members and being also secured fixedly to an interior sides of said boat, a cross brace secured between said rear portions of said tubular members, said rope extending from a rear ends of said tubular member rear portions and being passed around a pulley fixed on a downward extending shaft which at its lower end carries said motor, said shaft being journalled in a bearing block supported from said transom.

2. The combination as set forth in claim 1 wherein said rope extends from forward ends of said tubular member forward portions, each forward end of said rope being secured to an opposite side end of said pivotable foot rest for steering said boat, said foot rest being pivotally secured to a bracket fastened to said floor of said hull.

3. The combination as set forth in claim 2, wherein a switching console is secured in said boat before said seat for said operator, said switching console being positioned for being located between said operator's legs.

* * * * *